US006543652B1

(12) United States Patent
Kelder et al.

(10) Patent No.: US 6,543,652 B1
(45) Date of Patent: Apr. 8, 2003

(54) CLOSURE WITH DISPENSING VALVE

(75) Inventors: Maria Louise Kelder, Surrey (GB); Christopher Paul Ramsey, Oxfordshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/980,459

(22) PCT Filed: May 5, 2000

(86) PCT No.: PCT/GB00/01722

§ 371 (c)(1),
(2), (4) Date: Mar. 29, 2002

(87) PCT Pub. No.: WO00/75032

PCT Pub. Date: Dec. 14, 2000

(30) Foreign Application Priority Data

Jun. 4, 1999 (GB) ..... 9912977

(51) Int. Cl.[7] ..... G01F 11/30
(52) U.S. Cl. ..... 222/212; 222/494; 222/521
(58) Field of Search ..... 222/212, 494, 222/521, 519, 564, 547

(56) References Cited

U.S. PATENT DOCUMENTS 5,115,950 A * 5/1992 Rohr ..... 222/494
5,680,969 A * 10/1997 Gross ..... 222/494
6,290,108 B1 * 9/2001 Gross ..... 222/212

FOREIGN PATENT DOCUMENTS

WO WO 97/22520 11/1996

* cited by examiner

*Primary Examiner*—Philippe Derakshani
(74) *Attorney, Agent, or Firm*—Diller, Ramik & Wight

(57) ABSTRACT

A dispensing closure (1) incorporating a flexible, self-closing valve (5) and a transport seal for preventing accidential dispensing of product through the valve during transportation and storage of a filled container. The closure includes a cover (4), which is adapted to move axially between raised and lowered positions, to actuate the transport seal. The transport seal comprises a sealing plate (8), located between the valve and the container opening, which partially occludes the container opening but defines at least one dispensing orifice (9). To form the transport seal, the cover is lowered so that it presses part of the flexible valve against the sealing plate around the dispensing orifice/s, thereby blocking the dispensing passageway to the valve.

12 Claims, 3 Drawing Sheets

CLOSURE WITH DISPENSING VALVE

BACKGROUND OF THE INVENTION

The present invention relates to dispensing closures incorporating a self-closing valve, for use with squeeze-type containers, such as flexible bottles or tubes. The valve is adapted to open when the container is squeezed, to allow product to be dispensed and thereafter, once the container is released, the valve closes automatically. In particular, the invention relates to dispensing closures of this type which include a built-in seal to seal the valve and prevent accidental spillage of the contents of the container during transportation or storage.

Dispensing closures incorporating a self-closing valve are becoming more popular as after first opening by a user, the container may be stored and used without the need to open and close a separate lid. The valve ensures that the contents of the container will not leak even when the container is inverted. Such closures are therefore ideal for use with personal care products, such as shampoo and shower gel or foodstuffs, such as tomato ketchup and sauces.

A typical closure includes a flexible, self-closing valve arranged to cover the opening in a container. The valve is provided with one or more slits which define a normally closed orifice. When a user squeezes the container, the increased pressure within the container causes the orifice to open and the contents of the container are thereby dispensed. A common form of self-closing valve has two slits in a cross configuration to define four flaps, which are normally closed. When the container is squeezed, the flaps open to provide an orifice through which the contents of the container may be dispensed.

A typical dispensing closure incorporating a self-sealing valve comprises a body, arranged to co-operate with a container neck, the body defining a seat for the self-closing valve. The valve is held in place in the seat by a clip or retaining ring. The closure may also be provided with a lid to cover the valve during transportation and storage. The lid ensures that the valve remains clean and is not damaged before it reaches the consumer. Many closure designs incorporate a hinged lid, which is produced integrally with the body. Sometimes, the lid is provided with a projection, which is sized and arranged to co-operate with the closed valve and prevent it from opening when the lid is closed. This arrangement ensures that the contents of the container are not accidentally dispensed into the cavity between the closure body and the lid.

The disadvantage of such dispensing closures is that a lid or cover of some sort has to be provided covering the valve, to prevent leakage of the container contents during transportation or storage. The consumer does not need to use the lid after first opening, and it can hinder satisfactory use of the package. Furthermore, even with a lid, the contents of the container may seep into the cavity between the lid and the valve necessitating a requirement for a valve engagement projection as previously described. However, the provision of a projection makes the closure more difficult to manufacture. Finally, there may be circumstances where it is desirable to prevent contact between the container contents and the self-closing valve material during transportation and storage. Some products may have a deleterious effect on the valve material over time, which hinders the proper functioning of the valve.

A solution to these problems is proposed in the published PCT application WO97/22530. The proposed closure comprises a body, adapted to co-operate with a container opening, and a housing, which can be raised and lowered relative to the body using either a twisting or push-pull movement. The housing provides a seat for the dispensing valve, as in the conventional closures previously discussed, but also has a sealing plug located below the level of the valve, between the valve and the container opening. The closure body provides a sealing ring around the container opening. The sealing plug in the housing forms a seal with the sealing ring in the closure body, when the housing is in its lowered position, preventing leakage of the container contents. Thus, the valve is sealed inside the closure rather than by means of an external cover or lid. The sealing plug and sealing ring arrangement ensures that the container contents are prevented from coming into contact with the valve during transportation and storage of the package.

One of the disadvantages of this arrangement is that it is complicated and therefore difficult to manufacture and assemble. The design is based on the conventional valve dispensing closure with the addition of a separate sealing arrangement located inside the closure, in the dispensing passageway. As in the conventional valve dispensing closure, the valve requires a valve seat in the housing component with a retaining ring or clip to hold it in place. Furthermore, the housing component is more complicated as it also has to provide a sealing plug for the transport/storage seal. This arrangement relies on accurate alignment between the sealing plug and the sealing ring on the body to provide a satisfactory seal.

The applicants have found that a much simpler sealing arrangement can be provided inside the closure, in the dispensing passageway, requiring fewer components and less accurate alignment. The closure according to the invention is therefore, simpler and easier to manufacture and assemble than the closure proposed in WO97/22520.

SUMMARY OF THE INVENTION

The present invention provides a simplified closure having a dispensing valve and a transport/storage seal inside the closure within the dispensing passageway. The transport/storage seal is arranged so that the container/closure package can be sealed or unsealed by either twisting or push-pull movement of the outside of the closure by the user.

Accordingly the present invention provides a closure for a container opening, the closure comprising a housing, adapted to co-operate with the container opening and defining a dispensing passageway; a cover disposed on the housing for movement between lowered and raised positions relative to the housing; and a flexible dispensing valve, characterised in that the housing provides a sealing plate located, in use, between the dispensing valve and the container opening; the sealing plate adapted to partially occlude the container opening and defining at least one dispensing aperture; and the dispensing valve is arranged to seal the or all of the dispensing apertures when the cover is in its lowered position.

In the arrangement according to the invention, the dispensing valve is used to provide the "sealing plug" to block the dispensing apertures in the sealing plate during transportation and storage of the package. Thus, a separate sealing plug is not required, simplifying the design. Furthermore, due to the flexibility of the valve, it is able to conform to the contour of the dispensing aperture/s and therefore forms a good seal.

Advantageously, the valve and sealing plate are arranged in fixed orientation relative to one another within the housing and the housing is fixed in relation to the container opening. This arrangement has the advantage that a moving seal is not required between the cover and the housing.

In one such embodiment of the invention, the cover is adapted to press against part of the valve as the cover is lowered. This stretches part of the valve, so that it blocks the dispensing aperture or apertures and the lowered cover holds the stretched portion of the valve in place to ensure that the seal is retained. When the cover is raised, the natural elasticity of the valve material returns the valve to its original relaxed configuration and the contents of the container are able to pass through the dispensing apertures. Preferably an annular projection is provided on the internal surface of the cover. The projection is arranged to co-operate with the periphery of the dispensing valve and thereby stretch this portion of the valve. The dispensing apertures are arranged around the periphery of the sealing plate such that they are sealed by the stretched portion of the dispensing valve when the cover is in its lowered position.

The valve may be retained in a seat in the housing by a retaining ring or clip, as in the conventional dispensing valve closures. However, it will be apparent that the annular projection from the cover, may be configured to ensure that the valve is retained in the seat when the cover is in its raised and lowered positions. This arrangement removes the need for a separate retaining ring or clip and thereby further simplifies the design and assembly of the closure.

Alternatively, the cover may be adapted to press part of the valve against the dispensing aperture/s when it is in its lowered position, without stretching the valve. When the cover is raised, the valve remains covering the dispensing apertures but is no longer held in place by the cover. When a user squeezes the container, the internal pressure within the container forces the valve away from the dispensing apertures, thereby allowing the product in the container to be dispensed through the dispensing apertures and the valve orifice. After dispensing the product, the valve will naturally retract back against the sealing plate, due to the partial vacuum in the container.

In another embodiment of the invention, which is particularly suited for use with tubes, the housing forms one end of a tube or container and is an integral part thereof. The cover is located over the housing end of the tube. The tube or container is filled from the end furthest from the closure, in the conventional manner. This further simplifies the construction of the container/closure assembly.

The invention will now be described, by way of example only, with reference to the accompanying drawings, in which:

DESCRIPTION OF THE PREFERRED EMBODIMENTS

Figure 1:
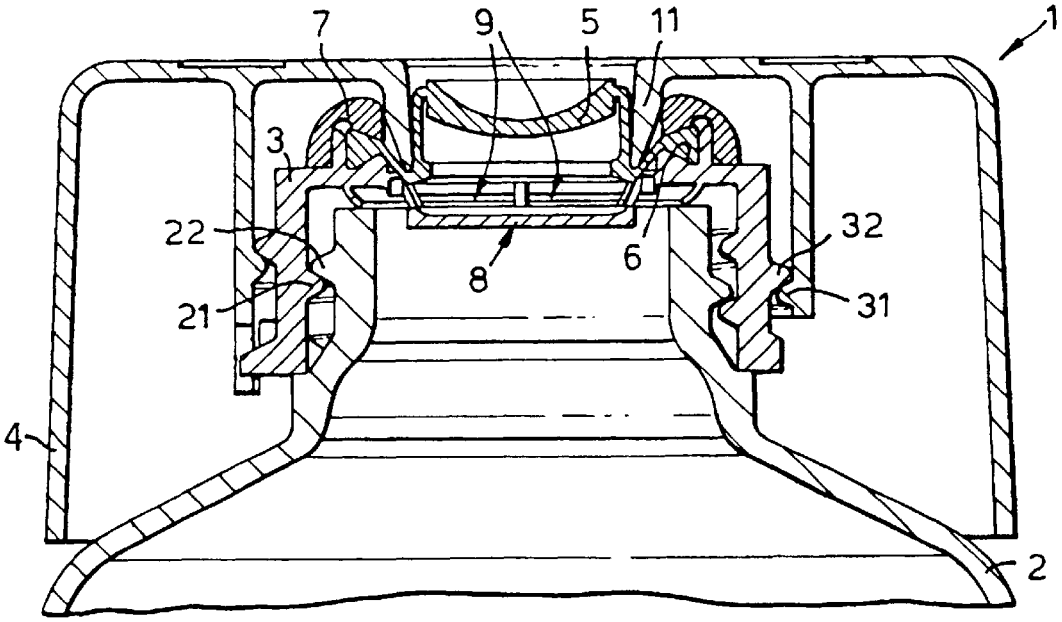
FIG. 1 shows a side section view of a closure according to a first embodiment of the invention, mounted on a container neck with the transport/storage seal in its opened configuration.

Wherever possible, like components in the Figures have been given the same reference numerals.

Figure 2:
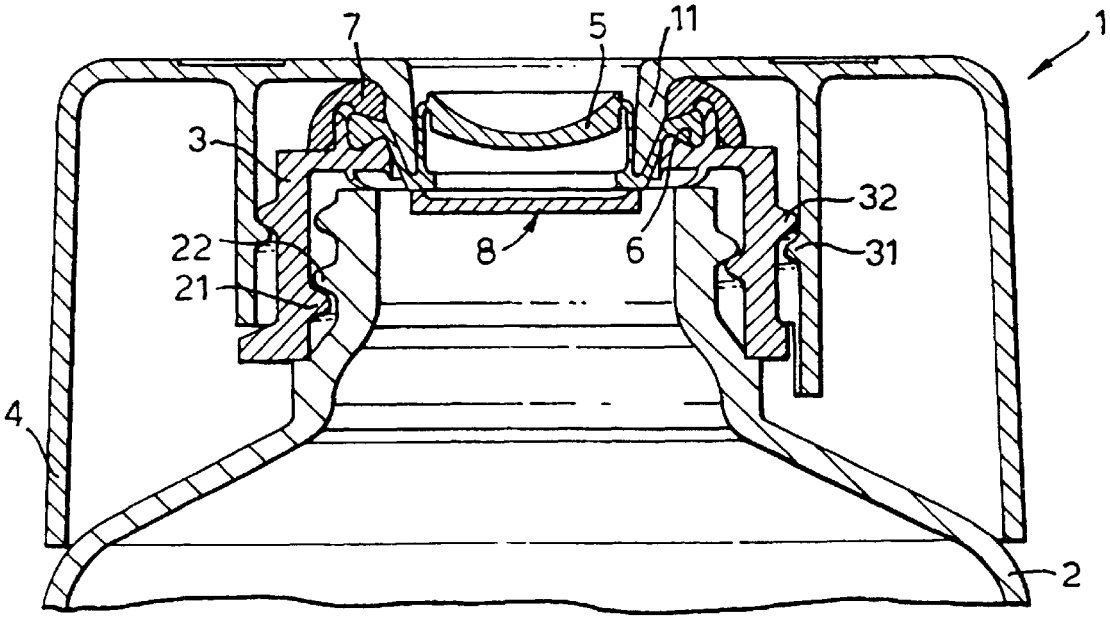
FIG. 2 shows a side section view of the closure shown in FIG. 1, with the transport/storage seal in its closed, sealed configuration.

Referring to FIGS. 1 and 2, a closure 1 is mounted on the neck portion of a container 2. The closure comprises a housing 3, which is adapted to co-operate with the neck portion of the container. For example, the housing may be provided with an internal thread 21, which co-operates with an external thread 22 on the container neck. Alternatively, the housing may be snap-fitted onto the container neck by means of co-operating snap beads. Ratchets (not shown) are provided on the container neck and housing to prevent rotation of the housing relative to the container.

The housing defines a dispensing passageway from the container opening and provides a valve seat 6 around the periphery of the dispensing passageway. A flexible, self-closing dispensing valve 5 is located in the valve seat 6 and may be held in place by a retaining clip or ring 7. Finally, the housing provides a sealing plate 8, which partially occludes the container opening, whilst defining a plurality of dispensing apertures 9 around its periphery (see FIG. 1). Therefore, it will be clearly understood that the housing 3 including the sealing plate 8 and the valve 5 are all held in fixed orientation relative to one another and to the container 2.

The closure further comprises a cover 4 disposed on the housing 3 so that it can be raised and lowered relative to the housing. The cover 4 may be provided with internal threads 31 arranged to co-operate with external threads 32 on the housing. Preferably, the co-operating threads 31, 32 are designed so that approximately a 90° rotation of the cover 4 provides the required axial movement of the cover relative to the housing 3. Stops (not shown) are provided on the housing and cover to prevent further rotation of the cover so that it is held captive on the container. Alternatively, the cover may be designed for push-pull engagement with the housing by providing suitable stop beads. The cover 4 also includes an annular projection 11 arranged to engage the flexible periphery of the valve 5.

In its open, unsealed configuration, the cover 4 is in its raised position relative to the housing 3, the valve 5 is relaxed (as shown in FIG. 1) and the contents of the container can be dispensed via the dispensing orifices 9 in the sealing plate 8. In its closed, sealed configuration, the cover 4 is in its lowered position relative to the housing 3 and the projection 11 stretches the peripheral skirt of the valve 5 down to seal against the sealing plate 8 (as shown in FIG. 2), thereby blocking the dispensing apertures 9.

Thus, during transportation or storage of the package, the cover 4 may be lowered to seal the dispensing passageway and thereby prevent accidental spillage of the container contents caused by overpressure, accidental squeezing of the container etc.

Figure 3:
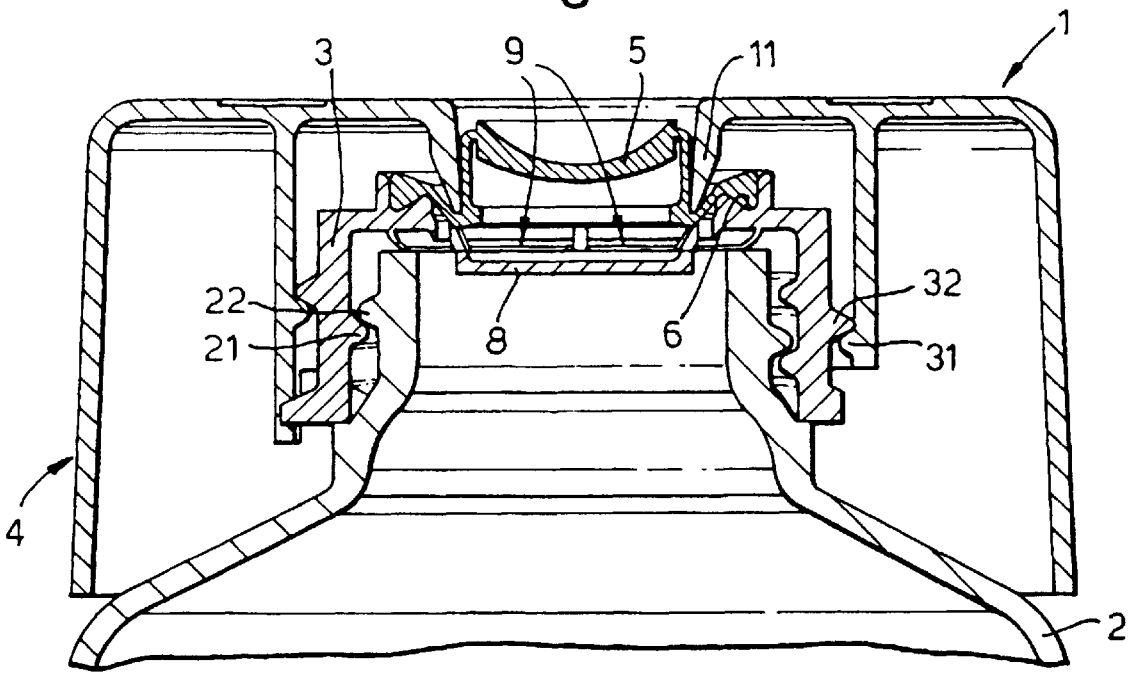
FIG. 3 shows a side section view of an alternative arrangement of the closure shown in FIG. 1, without a valve retaining clip.

FIG. 3 shows an alternative arrangement of the closure shown in FIGS. 1 and 2, without a retaining clip holding the valve 5 in the valve seat 6. As shown in FIG. 3, the projection 11 on the cover 4 engages the periphery of the valve 5, even when the cover is in its raised position.

Therefore, the projection 11 retains the valve 5 in the valve seat 6 and no retaining clip is required. The valve and storage/transport seal operates in exactly the same way as that described in relation to FIGS. 1 and 2.

Figure 4:
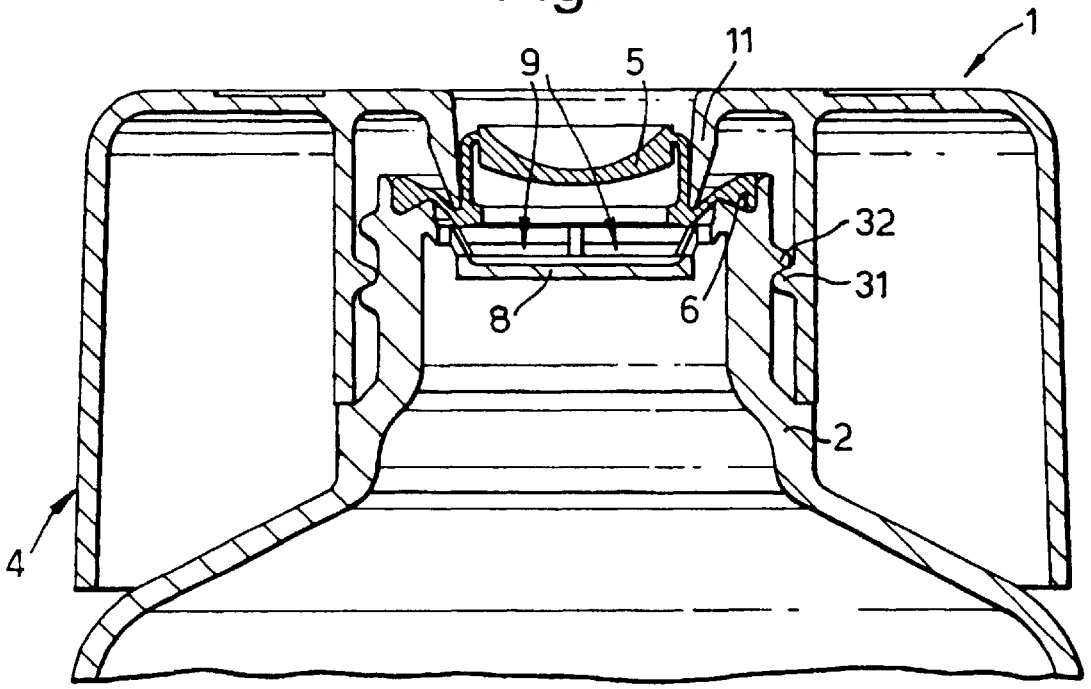
FIG. 4 shows a side section view of a closure/container combination according to a second embodiment of the invention, with the transport/storage seal in its opened configuration.

In a second embodiment of the invention, as shown in FIG. 4, the valve seat 6 and sealing plate 8 are provided as an integral part of the neck of the container 2. Thus, in this arrangement there is no separate housing. A valve 5 is retained in the valve seat 6. The closure 1 comprises a cover 4, which includes a projection 11 to engage the periphery of the valve as described in relation to FIGS. 1 to 3. This arrangement is particularly suited for use where the container is a flexible tube, as such containers are conventionally filled from the end furthest from the neck of the container.

Figure 5:
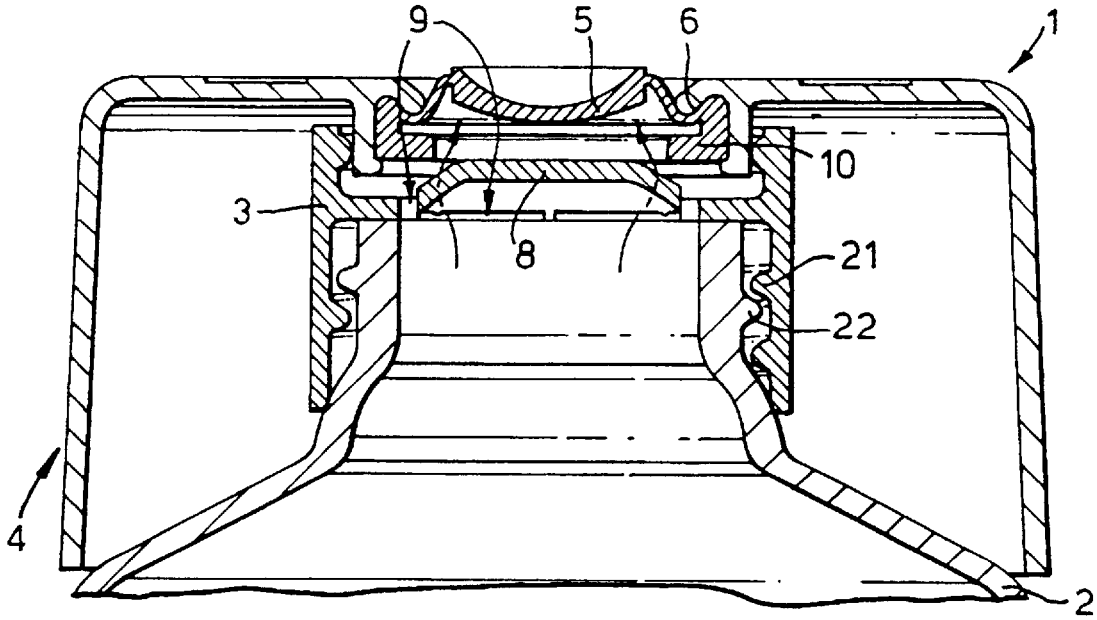
FIG. 5 shows a side section view of a closure according to a third embodiment of the invention, mounted on a container neck with the transport/storage seal in its opened configuration.
Figure 6:
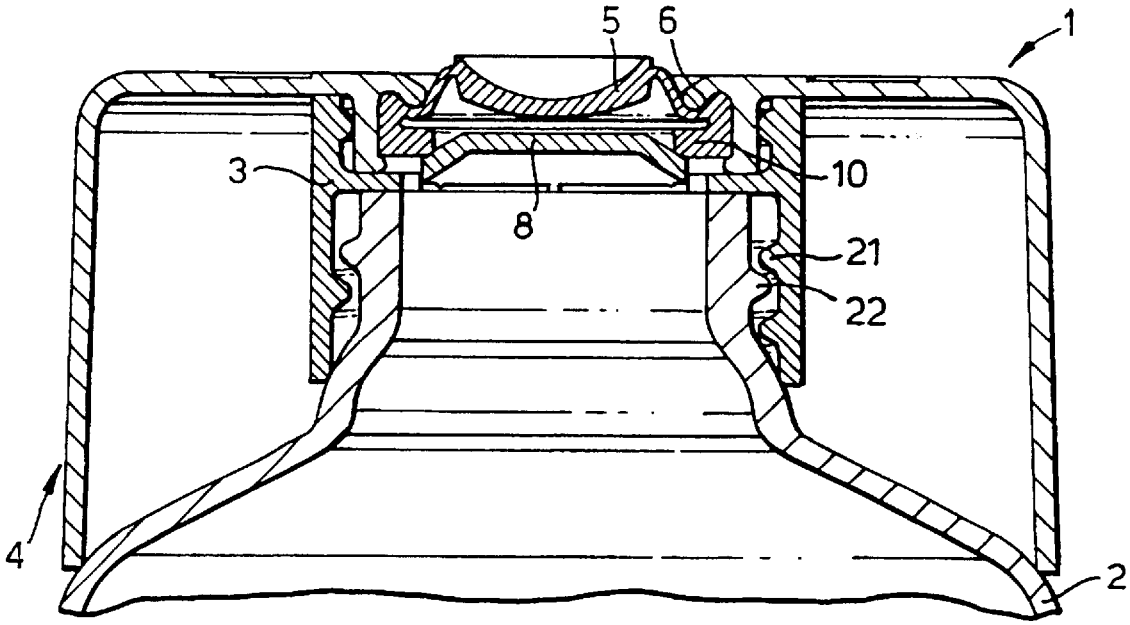
FIG. 6 shows a side section view of the closure shown in FIG. 5, with the transport/storage seal in its closed, sealed configuration.

FIGS. 5 and 6 show a third embodiment of the invention in which the valve seat 6 is provided in the cover 4. The valve 5 is retained in the cover 4 and is raised and lowered with the cover. A housing 3 is arranged to co-operate with the neck of a container as described in relation to FIGS. 1 to 3. The housing 3 incorporates a sealing plate 8, which partially occludes the container opening and defines a plurality of dispensing apertures 9 around its periphery. The cover 4 is arranged to be raised and lowered relative to the housing using either a twisting or push-pull movement. Hence, the housing 3 and cover 4 may be provided with co-operating screw threads or suitably spaced stop beads (not shown). When the cover 4 is in its raised position (as shown in FIG. 5), the valve 5 is also in a raised position and the periphery of the valve 10 is held clear of the frustoconical sealing surface provided by plate 8. The product in the container may then be dispensed through the dispensing apertures 9 (as indicated by the arrows in FIG. 5).

When the cover 4 is in its lowered position (as shown in FIG. 6), the periphery 10 of the valve 5 is forced into contact with the sealing plate 8, covering and thereby sealing the dispensing apertures 9. In this closed, sealed configuration, the product in the container cannot be dispensed through the dispensing apertures, even when the container is subjected to an increase in internal pressure.

It will be appreciated that the housing 3 and sealing plate 8 shown in FIGS. 5 and 6 may equally be provided as an integral part of the container 2 (in the same way as shown in FIG. 4). Furthermore, many variations of the valve and sealing arrangement in accordance with the invention will be readily apparent to those skilled in the art.

Although a preferred embodiment of the invention has been specifically illustrated and described herein, it is to be understood that minor variations may be made in the apparatus without departing from the spirit and scope of the invention, as defined the appended claims.

What is claimed is:

1. A closure (1) for a container opening, the closure comprising a housing (3), adapted to co-operate with the container opening and defining a dispensing passageway;

a cover (4) disposed on the housing (3) for movement between lowered and raised positions relative to the housing (3); and a flexible dispensing valve (5), the housing (3) provides a sealing plate (8) located, in use, between the dispensing valve and the container opening, the sealing plate is adapted to partially occlude the container opening, characterised in that the sealing plate (8), defines at least one dispensing aperture (9), and in that the dispensing valve is arranged to seal the or all of the dispensing apertures when the cover is in its lowered position.

2. A closure (1) according to claim 1, wherein the cover (4) is adapted to receive the dispensing valve (5) and the dispensing valve (5) is raised and lowered relative to the sealing plate (8) as the cover (4) is raised and lowered.

3. A closure (1) according to claim 1, wherein the housing (3) is adapted to receive the dispensing valve (5) and the cover (4) is adapted to press a portion of the dispensing valve (5) against the dispensing aperture/s (9) when the cover (4) is in its lowered position.

4. A closure (1) according to claim 3, wherein the cover (4) comprises a projection (11) adapted to stretch a portion of the dispensing valve (5) into contact with the dispensing aperture/s (9) when the cover (4) is in its lowered position.

5. A closure (1) according to claim 3, wherein the cover (4) is adapted to retain the valve (5) in the housing (3) when the cover (4) is in both its raised and lowered positions.

6. A closure (1) according to claim 4, wherein the cover (4) is adapted to retain the valve (5) in the housing (3) when the cover (4) is in both its raised and lowered positions.

7. A closure (1) and container (2) combination comprising a container, arranged to define a dispensing passageway, a cover disposed on the container around the dispensing passageway and adapted for movement between lowered and raised positions relative to the container and a flexible dispensing valve, the container provides a sealing plate located in the dispensing passageway, between the inside of the container and the dispensing valve, the sealing plate adapted to partially occlude the container opening, characterised in that p1 the sealing plate (8) defines at least one dispensing aperture (9), and in that the dispensing valve is arranged to seal the or all of the dispensing apertures when the cover is in its lowered position.

8. A closure (1) and container (2) combination according to claim 7, wherein the cover (4) is adapted to receive the dispensing valve (5) and the dispensing valve (5) is raised and lowered relative to the sealing plate (8) as the cover (4) is raised and lowered.

9. A closure (1) and container (2) combination according to claim 7, wherein the housing (3) is adapted to receive the dispensing valve (5) and the cover (4) is adapted to press a portion of the dispensing valve (5) against the dispensing aperture /s (9) when the cover (4) is in its lowered position.

10. A closure (1) and container (2) combination according to claim 9 wherein the cover (4) comprises a projection (11) adapted to stretch a portion of the dispensing valve (5) into contact with the dispensing aperture/s (9) when the cover (4) is in its lowered position.

11. A closure (1) and container (2) combination according to claim 9, wherein the cover (4) is adapted to retain the valve (5) in the housing (3) when the cover (4) is in both its raised and lowered positions.

12. A closure (1) and container (2) combination according to claim 8, wherein the cover (4) is adapted to retain the valve (5) in the housing (3) when the cover (4) is in both its raised and lowered positions.

* * * * *